US009536356B2

(12) United States Patent
Horree et al.

(10) Patent No.: US 9,536,356 B2
(45) Date of Patent: Jan. 3, 2017

(54) METHODS AND SYSTEMS FOR USING MULTIPLE PERMANENT POSTAGE RATES IN MAILING MACHINES

(75) Inventors: Richard Horree, Brookfield, CT (US); Wojciech M. Chrosny, Orange, CT (US); Linda S. Lin, Easton, CT (US); George M. Macdonald, New Canaan, CT (US)

(73) Assignee: Pitney Bowes Inc., Stamford, CT (US)

( * ) Notice: Subject to any disclaimer, the term of this patent is extended or adjusted under 35 U.S.C. 154(b) by 1847 days.

(21) Appl. No.: 11/966,335

(22) Filed: Dec. 28, 2007
(Under 37 CFR 1.47)

(65) Prior Publication Data

US 2009/0171861 A1 Jul. 2, 2009

(51) Int. Cl.
*G07B 17/02* (2006.01)
*G07B 17/00* (2006.01)

(52) U.S. Cl.
CPC . *G07B 17/00362* (2013.01); *G07B 2017/0037* (2013.01); *G07B 2017/00427* (2013.01); *G07B 2017/00967* (2013.01)

(58) Field of Classification Search
CPC ..... G07B 17/00508; G07B 17/0008; G07B 17/00193; G07B 17/00362; G07B 17/00024; G07B 17/00435
USPC ..... 705/401–410
See application file for complete search history.

(56) References Cited

U.S. PATENT DOCUMENTS 4,504,915 A * 3/1985 Daniels et al. ..... 705/409
5,661,653 A 8/1997 Kulik ..... 705/410
5,715,164 A * 2/1998 Liechti et al. ..... 705/410
5,812,990 A 9/1998 Ryan, Jr. et al. ..... 705/403
5,905,232 A * 5/1999 Schwartz et al. ..... 177/25.15
5,946,671 A * 8/1999 Herring ..... 705/404
6,061,670 A * 5/2000 Brand ..... 705/404
6,574,000 B1 6/2003 Sansone ..... 358/1.1
6,619,544 B2 9/2003 Bator et al. ..... 235/381
6,823,321 B2 11/2004 Johnson et al. ..... 705/403
6,853,989 B2 2/2005 Allport et al. ..... 705/401
7,143,068 B2 11/2006 Kissner et al. ..... 705/61
7,152,049 B2 12/2006 Ryan, Jr. ..... 705/401
7,203,666 B1 4/2007 Gravell et al. ..... 705/401
7,225,170 B1 5/2007 Ryan, Jr. ..... 705/401
7,233,930 B1 6/2007 Ryan, Jr. ..... 705/408
7,272,581 B2 9/2007 Athens et al. ..... 705/50
2005/0065896 A1* 3/2005 Kummer et al. ..... 705/401

OTHER PUBLICATIONS

"FP mailing solutions introduces new digital postage meter series." (Jan 17, 2007). Business Wire Retrieved from http://dialog.proquest.com/professional/docview/671864164?accountid=142257.*

(Continued)

*Primary Examiner* — Michael Harrington

(74) *Attorney, Agent, or Firm* — Michael J. Cummings; Charles R. Malandra, Jr.; Steven J. Shapiro

(57) ABSTRACT

A mailing machine that provides for permanent postage is described. Postage may be purchased at one point of time at a then prevailing rate and used in the future at the same effective purchasing power even if a new more expensive rate schedule is in effect. The mailing machine provides for the accounting of such rate purchased postage using a Postal Security Device and may include multiple rate-table based accounts each associated with a particular postage rate table.

20 Claims, 5 Drawing Sheets

(56) References Cited

OTHER PUBLICATIONS

USPS Press Release 06-031, Postal Service Seeks Price Adjustments, Governors propose "forever stamp", USPS May 3, 2006.
USPS Press Release 07-23, USPS Governors Approve Majority of Postal Regulatory Commission's Price Recommendations, Including Forever Stamp, Mar. 19, 2007.
Performance Criteria for Information-Based Indicia and Security Architecture for Open IBI Postage Evidencing Systems (PCIBI-O), draft, The United States Postal Service (USPS), dated Feb. 23, 2000, pp. 1-79.
Performance Criteria for Information-Based Indicia and Security Architecture for Closed IBI Postage Evidencing Systems (PCIBI-C), draft, The United States Postal Service (USPS), dated Jan. 12, 1999, pp. 1-49.

* cited by examiner

METHODS AND SYSTEMS FOR USING MULTIPLE PERMANENT POSTAGE RATES IN MAILING MACHINES

FIELD OF THE INVENTION

The invention disclosed herein relates generally to mailing machines, and more particularly to methods and systems including mailing machines comprising multiple postage accounts including multiple rate-table based accounts each associated with a particular postage rate table.

BACKGROUND OF THE INVENTION

Mailing machines for printing postage indicia on envelopes and other forms of mail pieces have long been well known and have enjoyed considerable commercial success. There are many different types of mailing machines, ranging from relatively small units that handle only one mail piece at a time, to large, multi-functional units that can process hundreds of mail pieces per hour in a continuous stream operation.

The larger mailing machines often include different modules that automate the process of producing mail pieces, each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. Since the mailing machine may be set to dispense postage in penny increments, and may also be set to appropriate standard or discounted rates as applicable given the weight of a mail piece and rate settings, the typical mailing machine user will save money by applying the correct postage as compared with a USPS customer who applies stamps of set denomination and thus, usually pays for excess postage.

On May 3, 2006, The Governors of the U.S. Postal Service (USPS) proposed a "forever stamp" as part of a broader rate adjustment plan. USPS Customers will be able to purchase a special "Forever" First-Class stamp at current prices that would then be acceptable as sufficient First-Class postage for mailing any future one ounce letter, no matter how much postage prices might increase after the stamp was purchased. While such a First-Class "Forever" stamp may be desirable to retail USPS First-Class low volume letter mailers, it would not appear as useful to larger scale mailers.

SUMMARY OF THE INVENTION

The present application describes illustrative embodiments of systems and methods for providing for "permanent" (fixed-rate) postage including modified postal indicia. Postage may be purchased at one point in time at a then-prevailing rate. Thereafter, that postage may be used in the future at the same effective purchasing power even if a new more expensive rate schedule is in effect. The mailing machines and methods for using them described herein provide for the accounting of such purchased permanent rate postage using a Postal Security Device. In certain illustrative embodiments, the mailing machines include multiple rate-table based accounts each associated with a particular postage rate table.

In one illustrative example, a Postal Security Device includes at least one additional descending register associated with at least one additional rate table for use in accounting for permanent postage values.

In another illustrative example, a Postal Security Device includes at least one permanent postage database record for use in accounting for permanent postage values.

DESCRIPTION OF THE DRAWINGS

The accompanying drawings illustrate several alternative embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
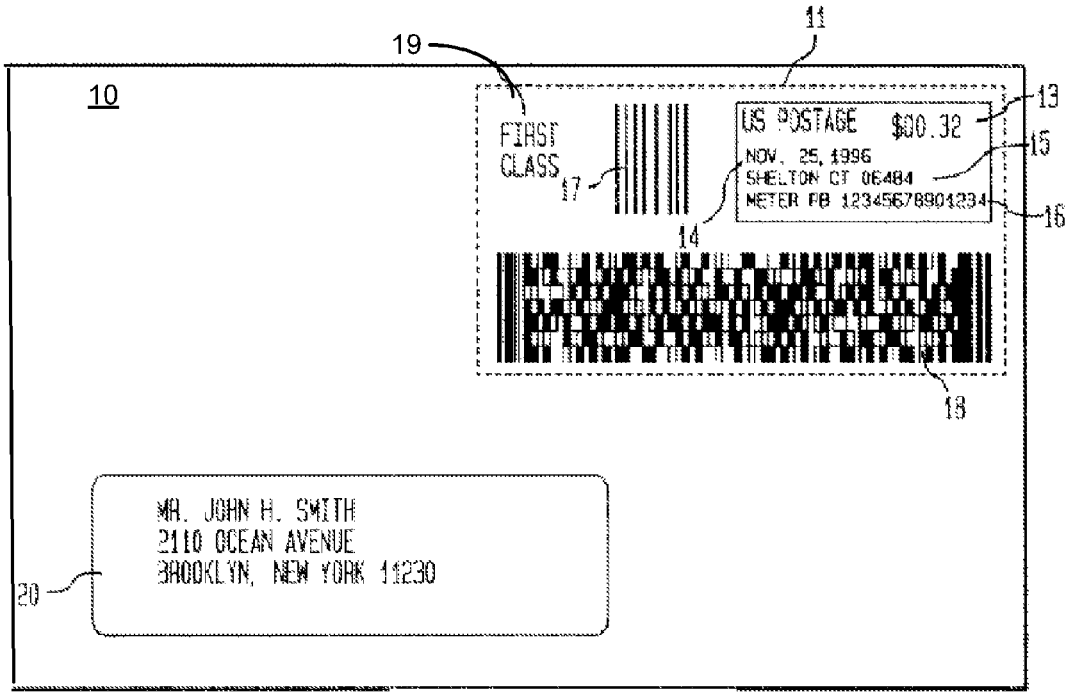
FIG. 1 (PRIOR ART)
FIG. 1 is a drawing of a prior art mail piece including an Information-Based Indicia.

Mailing machines incorporating postage meters, such as described herein, typically include at least one control processor, such as, for example, a microprocessor, that performs user interface and controller functions for the mailing machine. Additionally, a physically secure coprocessor system is embedded in the mailing machine, typically in a postage meter device, and is utilized to maintain a local postage funds repository in a Postal Security Device (PSD). The PSD typically stores a running ascending register that is incremented during the lifetime of the postage meter and a descending register that stores the then current amount of postage available in the PSD.

Specifically, the control device provides all user interfaces, executes control of the mailing machine and print operations, calculates postage for debit based upon rate tables, provides the conduit for the PSD to transfer postage indicia to the printer, operates with peripherals for accounting, printing and weighing, and conducts communications with a data center for postage funds refill, software download, rates download, and market-oriented data capture. The control device, in conjunction with the embedded PSD, provides the system meter that satisfies U.S. and international postal regulations regarding closed system information-based indicia postage meters.

The United States Postal Service (USPS) initiated the Information-Based Indicia Program (IBIP) to enhance the security of postage metering by supporting new methods of applying postage to mail. The requirements for a "closed" postage system are defined in the "Performance Criteria for Information-Based Indicia and Security Architecture for Closed IBI Postage Metering System (PCIBI-C), dated Jan. 12, 1999. A closed system is typically a mailing machine that has at least certain subsystems dedicated to the production of information-based indicia and related functions, similar to the previous generation of dedicated electro-mechanical postage meters. Such systems typically include a print mechanism for printing postal indicia.

The PCIBI-C specification defines the requirements for the indicium to be applied to mail produced by closed systems. The indicium includes a two-dimensional (2D) barcode and certain human-readable information. Some of the data included in the typical IBIP barcode includes, for example, the PSD manufacturer identification, PSD model identification, PSD serial number, values for the ascending and descending registers of the PSD, postage amount, and date of mailing. In addition, a digital signature is required to be created by the PSD for each mail piece and placed in the digital signature field of the barcode. Several types of digital signature algorithms are supported by the IBIP, including, for example, the Digital Signature Algorithm (DSA), the Rivest Shamir Adleman (RSA) Algorithm, and the Elliptic Curve Digital Signature Algorithm (ECDSA). Two-dimensional barcodes used in postage payment indicia printing applications typically are formatted using the PDF417 format or the DATAMATRIX format.

Referring to FIG. 1, a drawing of a prior art mail piece 10 including a USPS Compliant Information-Based Indicia 11 is shown. Such indicium may be printed using a mailing machine as described herein. The postal indicia 11 contains a postage value, such as dollar amount 13, the date 14 that the postal indicia was affixed to the mail piece, the origin the mail piece was mailed from 15, the postal meter serial number 16, a FIM code 17 and a 2D IBI bar code 18. Some of the human readable information described above is also included in the digitally signed barcode 18 in machine readable form. Some of the information provided in the indicium 11, such as PSD ascending and descending register values, is included only in the barcode. The IBI Indicia 11 also contains a service class indication 19 for the mail piece. For example, this particular mail piece is being sent by USPS FIRST CLASS MAIL service. The mail piece 10 also includes a destination address field 20.

However, such prior art postal payment indicium 11 cannot be advantageously utilized in a "Forever" postage capable system such as to provide "permanent" postage that may be used for a particular class of mail piece and service irrespective of future rate increases. For example, there is no way to indicate that a valid "Forever" postage payment was being made or to reflect the paid value of such a previously purchased postage amount. The value 13 could not indicate the paid value for the postage (except in the special case when Forever postage is used during the time that the same purchase rate is in effect). Furthermore, there is no mechanism available to alert the postal authorities that "Forever" postage is being utilized and that perhaps a different refund policy should be employed. More importantly, there is no mechanism for accurately maintaining the integrity of the ascending and descending register system used to secure postal funds. Accordingly, improved indicium are required to accommodate a "Forever" postage capability using mailing machines.

Certain postage systems utilize a "virtual" PSD, such as with certain Internet based postage solutions. The USPS has established the Performance Criteria for Information-Based Indicia and Security Architecture for Open IBI Postage Metering System (PCIBI-O) a published draft specification dated Feb. 23, 2000. An illustrative "virtual meter" system is described in commonly-owned U.S. Pat. No. 6,619,544 B2, entitled System and Method for Instant Online Postage Metering, issued Sep. 16, 2003 to Bator, et al. and incorporated herein by reference. In describing the present invention, illustrative embodiments of a mailing machine including a local PSD are described. However, alternative systems using virtual meter subsystems may be advantageously utilized. Illustrative methods for providing IBIP indicia are described in commonly-owned U.S. Pat. No. 6,574,000 B1, entitled System for the Enhancement of Information Based Indicia and Postage Security Devices, issued Jun. 3, 2003 to Sansone and incorporated herein by reference.

Figure 2:
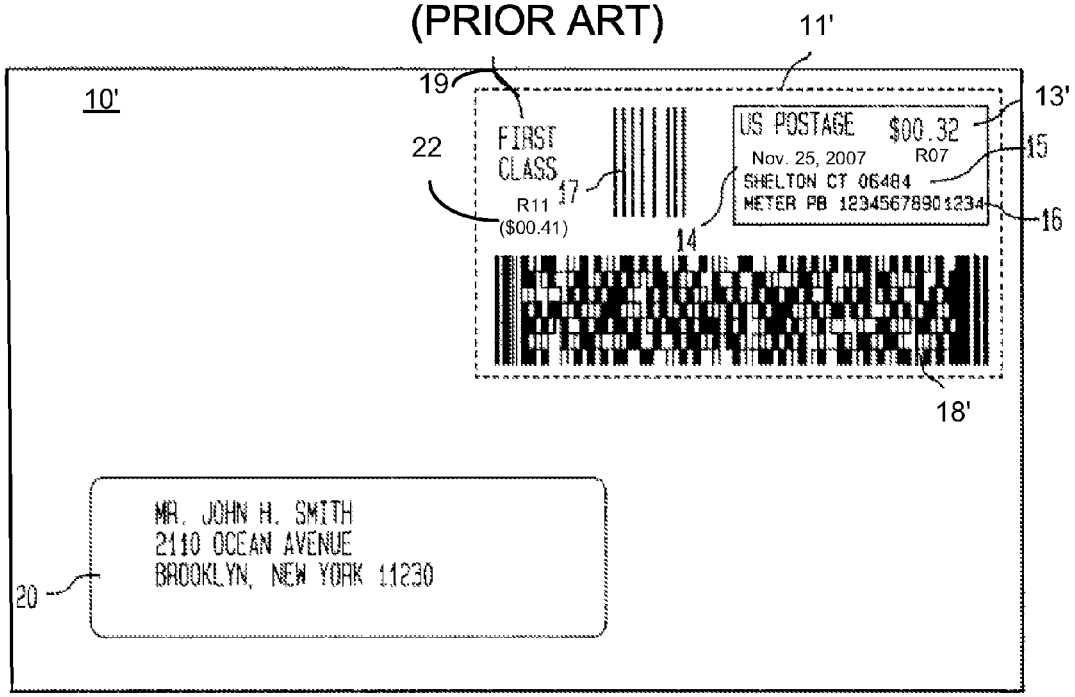
FIG. 2 is a drawing of a mail piece including a modified Information-Based Indicia according to an illustrative embodiment of the present application.

Referring to FIG. 2, a drawing of a mail piece 10' including a modified Information-Based Indicia 11' according to an illustrative embodiment of the present application is shown. The new indicium supports certain aspects of a "Forever" postage capability using mailing machines. Here, a mailing machine includes the capability to purchase and store "Forever" postage at then in effect rate schedules for future use.

For convenience, the postal rates are assigned increasing identification numbers from a baseline on a go forward basis. Furthermore, alternatively the rate designations may use different codes or even a date. However, the rate information may be stored in machine readable form only such as included in barcode 18' so that the postal employee would be required to scan the barcode to determine the information.

In the illustrative example shown here, the postage was purchased when rate R07 was in effect and is being used when rate R11 is in effect. For illustrative purposes, the full FIRST CLASS postage rate for a one ounce envelope is $00.32 for rate R07 and $00.41 for rate R11. Here, the mailing machine user applies a rate R07 Forever FIRST CLASS indicium on mail piece 10' during the time when rate R11 is in effect. Accordingly, postal value field 13' includes the value of the postage paid ($00.32) and also an indicator of the then applicable rate (R07) when the postage was originally purchased.

In order to allow a human readable indication of the postage being utilized, new field 22 is provided in indicium 11' to indicate the current equivalent postage rate that would be applicable to the mail piece so that a letter carrier or other postal employee could have readily available access to such information for comparison purposes. Here, a letter carrier would know that a Forever FIRST CLASS stamp originally purchased for $00.32 was being utilized with an equivalent current value of $00.41. Furthermore, the 2D barcode 18' is modified to include the modified field 13' and new field 22. As also described below, the 2D barcode may include traditional or modified PSD register values. For example, multiple descending register values may be stored in 2D barcode 18'. Furthermore, in this or any of the embodiments described, the new fields may be included in the information processed to provide a digital signature to secure the indicium as appropriate.

Figure 3:
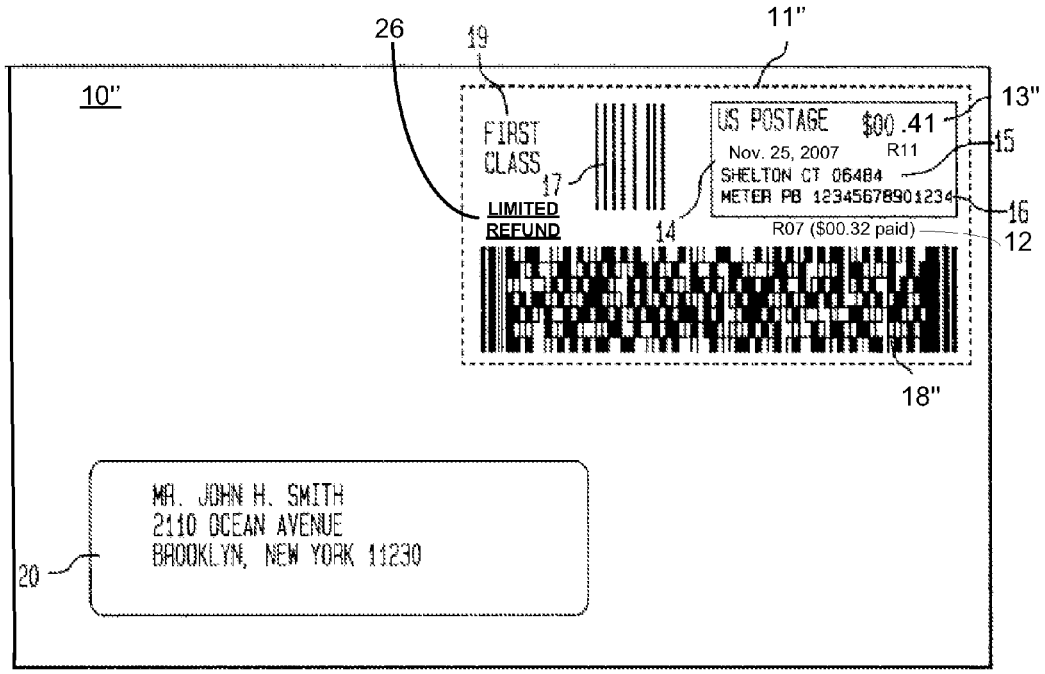
FIG. 3 is a drawing of a mail piece including a modified Information-Based Indicia according to another illustrative embodiment of the present application.

Referring to FIG. 3, a drawing of a mail piece 10" including a modified Information-Based Indicia 11" according to another illustrative embodiment of the present application is shown. In this illustrative example, the postage was also purchased when rate R07 was in effect and is also being used when rate R11 is in effect. However, postal value 13" includes the current value of the first class postage "Forever" indicium. In order to provide an indication of the original purchase price of the "Forever" postage, new original postage rate field 12 is added to indicate that the original cost was $00.32. Furthermore, a new notice field 26 is added to indicate that a "Limited Refund" policy may be in effect for this indicium. For example, a policy may be utilized that such indicium may only be exchanged for similar postage. Furthermore, 2D barcode 18" may be modified to include such a limited refund notice in machine readable form in additional to any of the modifications described with reference to 2D barcode 18'.

Figure 4:
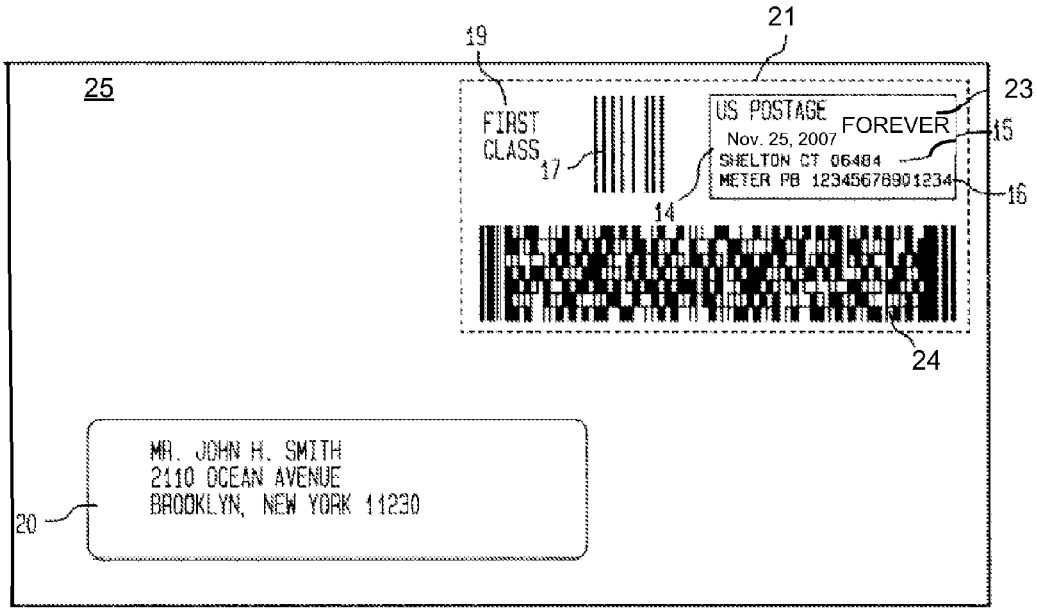
FIG. 4 is a drawing of a mail piece including a modified Information-Based Indicia according to yet another illustrative embodiment of the present application.

Referring to FIG. 4, a drawing of a mail piece 25 including a modified Information-Based Indicia 21 according to yet another illustrative embodiment of the present application is shown. In this illustrative example, the postage value indicator 23 is merely the term "FOREVER." The service class indicator 19 is still utilized, so the current value could be determined by rating the envelope. However, the human readable portions of the indicium 21 do not indicate a value or rate associated with the "Forever" postage. The 2D barcode 24 may optionally include such information in machine readable form to permit a postal employee to scan and decode the information in addition to any of the other appropriate barcode modifications described herein.

Figure 5:
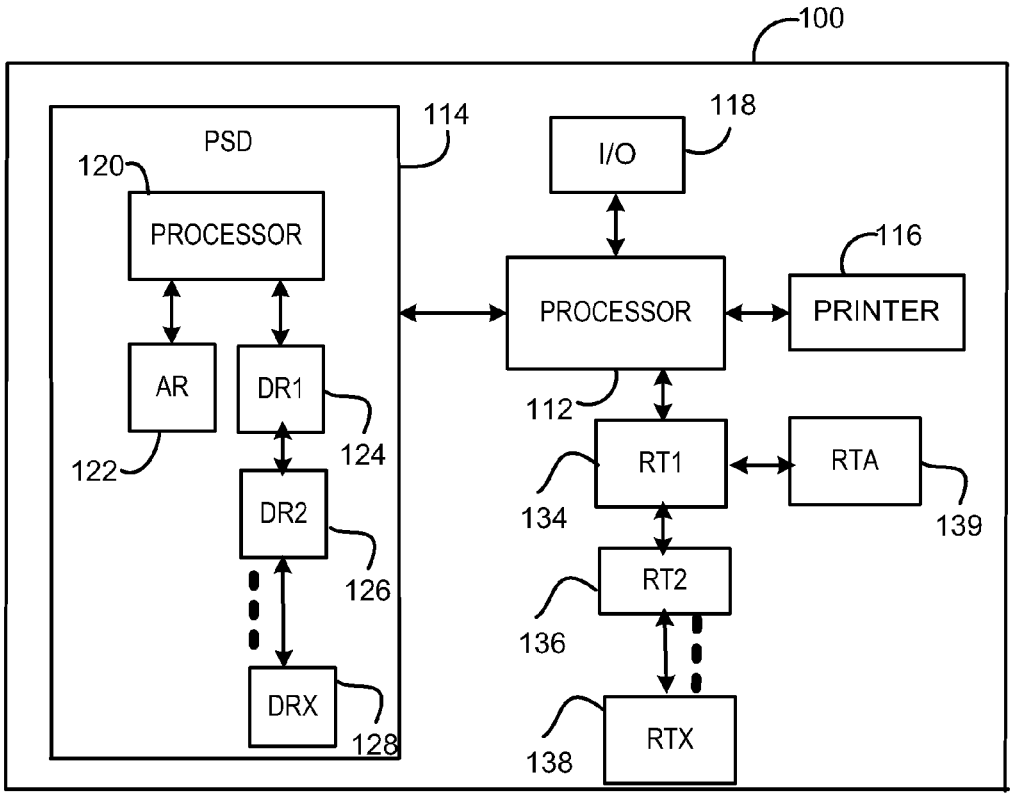
FIG. 5 is a block diagram of relevant portions of a mailing machine according to an illustrative embodiment of the present application.

Referring to FIG. 5, a block diagram of relevant portions of a mailing machine 100 according to an illustrative embodiment of the present application is shown. Mailing Machine 100 may comprise modifications to one of the DM SERIES mailing machines available from PITNEY BOWES INC. of Stamford, Conn. Mailing machine 100 includes a printer 116 adapted to print postage indicia on a mail piece. Printer 116 is coupled to processor 112, which controls operation of mailing machine 100. Processor 112 is coupled to one or more input/output devices 118, such as, for example, a keyboard and/or display unit for the input and output of various data and information. Processor 112 is further coupled to a PSD 114 that generates the indicium and calculates a digital signature included in the indicium. PSD 114 comprises a physically secure device such as an appropriate IBUTTON device available from Maxim Integrated Products, Inc. of Sunnyvale, Calif. including appropriate modifications of the DS1955B device. Alternatively, a secure cryptographic device such as the MYK-xx device available from MYKOTRONX, INC. or Torrance, Calif. may be utilized. Additionally, alternative PSD devices such as those available from PITNEY BOWES INC. of Stamford, Conn. may be modified as described and utilized.

PSD 114 includes an ascending register (AR) 122 and a first descending register (DR) 124 in which critical accounting data relevant to the operation of the mailing machine 100 is stored. Traditionally, mailing machines include one descending register. It should be understood that PSD 114 may also include other types of registers as well. Here, PSD 114 includes at least one more descending register DR2 126 through DRx 128. Since the PSD is typically a secure coprocessor, it may have limited memory capacity as compared to the main processor 112. Here, rate tables are stored in memory operatively connected to the main processor 112. However, the rate tables may alternatively also be stored in PSD memory.

For example, rate table RT1 134 includes the current USPS rate table. Rate table RTA 139 includes the next proposed rate table that will become the active rate table on a scheduled future date. Rate table RT2 corresponds to the rate table then in effect when the permanent postage associated with descending register DR2 126 was purchased. Accordingly, DR2 126 is associated with RT2 136. Similarly, additional optional associated rate tables RTx 138 and descending registers DRx 128 are provided. Here, each new rate table is sequentially numbered from the first time permanent or "Forever" postage is available and an associated descending register and rate table file is provided for each using the same register values across the postage meter population. In an alternative, if only certain rate tables are utilized by a particular meter, the rate table may be assigned to the next available rate table field such as RT2 and identified by a rate table identifier or date. The associated descending register may also be so identified.

The rate table information may be downloaded from a central data center at the same time postage is purchased or at another time when the mailing machine is in communication with the data center. A system for manipulating postal rate tables in a mailing machine is described in commonly-owned U.S. Pat. No. 5,661,653, entitled Custom Class Selection In Automated Mail Processing, issued Aug. 26, 1997 to Kulik and incorporated by reference herein.

PSD 114 further includes a processor 120 that performs cryptographic operations necessary for generating the indicium for each mail piece and calculating the digital signature. The processor also processes the register operations to maintain the registers. The cryptographic operations to be performed by processor 120 could be stored in a processor memory (not separately shown) coupled to or embedded in the processor 120. The indicium, including the digital signature, is passed to the processor 112, which then passes the assembled indicium to printer 116 for printing on a mail piece. Alternatively, processor 112 could perform some of the operations related to generation of the indicium that do not require secure cryptographic processing. A system for processing indicium calculations using a PSD is described in commonly-owned U.S. Pat. No. 7,272,581 B2 entitled Method And System For Optimizing Throughput Of Mailing Machines, issued Sep. 18, 2007 to Athens, et al. and incorporated by reference herein.

In accordance with the present embodiment, each permanent postage descending register DR2 126 through DRx 128 may be used only for postage purchased when that particular rate was in effect. After the associated rate table is no longer in effect, that particular descending register may no longer have postage added to it. The particular descending register may then be used in the future only until all of the postage is used. Since a small amount of postage might remain, the user could process a refund request when the particular descending register is nearly empty or a facility for combining postage from two of the descending registers may be alternatively implemented. Furthermore, the descending register scheme is modified such that the descending register value and identity (e.g., $125.50, DR2) is provided in the applicable 2D barcode in the postal indicium to uniquely identify the postage applied.

In an alternative embodiment, purchased Forever postage is limited to particular classes and rating/weight breaks of mail. For example, a FIRST CLASS one ounce rate may be one of the limited increments. Therefore the alternative PSD would include a decision means for allowing only certain classes and rate/weight breaks to debit the new descending registers DR2 126 through DRx 128, e.g. FIRST CLASS one ounce mail. At the same time, other classes and rate/weight breaks not in the limited set would be processed using the standard descending register DR1 124. Such decision means include processor 120 and/or 112.

The operations performed by the PSD 114 in generating an indicium include at least three sections: a pre-debit section, a perform debit operation section, and a complete debit operation section. In the pre-debit section, the postage value, mailing date, and other data needed to produce the indicium are input into the PSD 114. In this embodiment, the data would include the appropriate descending register identification. In the perform debit section, the registers 122, 124-128 of PSD 114 are updated based on the postage amount. In the complete debit operation, the data from registers 122, 124-128 is logged to redundant registers (not shown) in PSD 114, along with other maintenance functions necessary for the PSD 114. Additionally, the mailing machine 100 may separately report permanent postage usage and history data when providing any data capture information to the remote data center (not shown).

A representative table of associations between descending registers and rate tables is shown below. A table accommodating 50 rows should be sufficient to store rate table change information during the projected useful life of the postage meter, but a larger number of rows may be utilized. The then current rate set will have one PCN for normal postage purchases and a second PCN code for permanent postage purchases.

TABLE 1

| Rate Table | Descending Register | Rate Date | Rate PCN |
|---|---|---|---|
| RT1 | DR1 | May 14, 2007 | 9X55 |
| RT2 | DR2 | Jan. 8, 2006 | 9Y54 |
| RT3 | DR3 | May 14, 2007 | 9Y55 |
| . . . | . . . | . . . | . . . |
| RTx | DRx | TBD | TBD |

Figure 6:
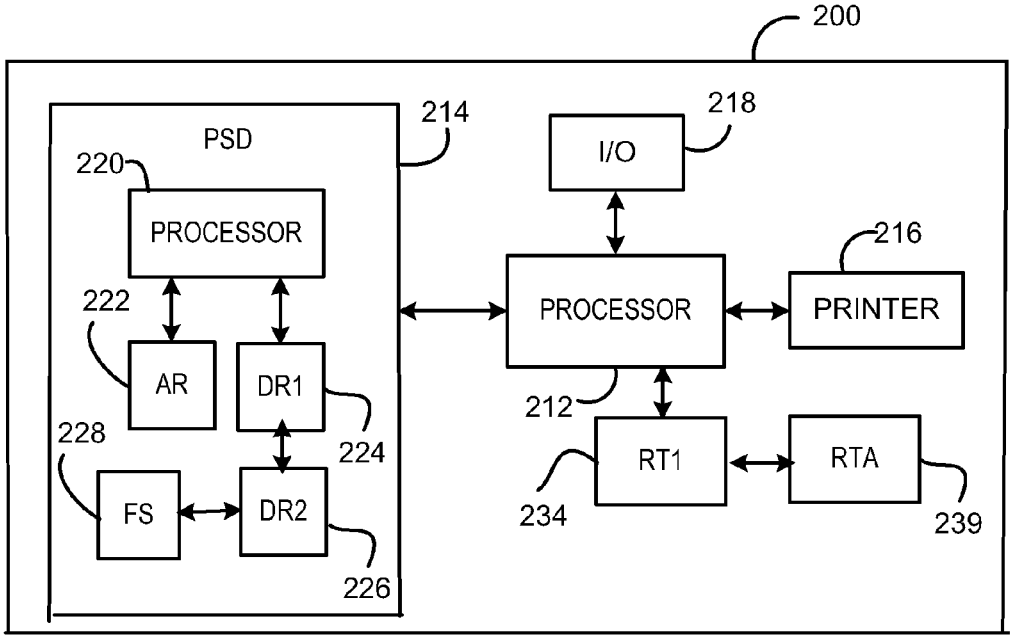
FIG. 6 is a block diagram of relevant portions of a mailing machine according to another illustrative embodiment of the present application.

Referring to FIG. 6, a block diagram of relevant portions of a mailing machine 200 according to another illustrative embodiment of the present application is shown. Mailing machine 200 includes a printer 216 adapted to print postage indicia on a mail piece. Printer 216 is coupled to processor 212, which controls operation of the mailing machine 200. Processor 212 is coupled to one or more input/output devices 218, such as, for example, a keyboard and/or display unit for the input and output of various data and information. Processor 212 is further coupled to an active rate table memory RT1 234 and a pending rate table memory RTA 239. Processor 212 is further coupled to a PSD 214 that generates the indicium and calculates a digital signature included in the indicium.

PSD 214 includes processor 220 with ascending register AR 222 and descending register DR1 224. An additional descending register DR2 226 is included to account for all permanent postage stored in the PSD. An additional Forever postage database FS 228 stores specific information regarding the permanent postage purchased, such as postage PCN numbers, rate identifiers and dates, as well as the amount of stamps or total value purchased in a transaction. The PCN numbers may be vendor specific and used in the purchase transaction, but not necessarily stored in the PSD. The PSD processor 220 can then utilize that database when accounting for credits associated with postage purchases or postage debits when the PSD is used by the mailing machine. A separate descending register DR2 226 is utilized for permanent postage. Alternatively, a single descending register may be utilized if a permanent postage database is used to account for permanent postage transactions.

A representative table showing a permanent postage PSD database FS is shown below. A database table accommodating 150 rows should be sufficient to store rate table and discrete class rating/weight break data during the projected useful life of the postage meter, but a larger number of rows may be utilized. The then current rate set will have one PCN for normal postage purchases and a second PCN code for permanent postage purchases. FC1 represents a FISRT CLASS one ounce postage increment. PM1 represents a PRIORITY MAIL one pound postage increment. In this example, since RT2 is expired, those stamp database entries may not be incremented through new purchases and may only be used.

TABLE 2

| Rate Table | Class and Rating/ Weight Break | Rate Date | Class/Rate PCN | # Stamps |
|---|---|---|---|---|
| RT2 | FC1 | Jan. 8, 2006 | 8Y54 | 87 |
| RT2 | PM1 | Jan. 8, 2006 | 8Y55 | 54 |
| RT3 | FC1 | May 14, 2007 | 8Z54 | 2000 |
| . . . | . . . | . . . | . . . | |
| RTx | XXx | TBD | TBD | |

Several systems for providing postage meter refills using a remote data center have been described. For example, a remote postage meter refill system is described in commonly-owned U.S. Pat. No. 7,143,068 B2, entitled, Remote Postage Meter Resetting System Having Rebate Generating Capabilities, issued Nov. 28, 2006 to Kissner, et al. and incorporated herein by reference. Another system for cryptographically securing such refill operations is described in commonly-owned U.S. Pat. No. 5,812,990, entitled, System And Method For Providing An Additional Cryptography Layer For Postage Meter Refills, issued Sep. 22, 1998 to Ryan, Jr., et al. and incorporated herein by reference.

Here, a modified postage refill operation is utilized in which Forever or permanent postage is assigned a specific PCN code for each effective rate table or each effective postage class in a particular rate table/set. Furthermore, specific rate/service class/rating combinations may be sold under specific PCN with appropriate additions to a permanent postage PSD FS database or additional descending registers. For example, a one-ounce letter USPS FIRST CLASS permanent postage "stamp" value may be sold in discrete units for use in a postage meter. Similarly, a one pound USPS PRIORITY MAIL service "stamp" may be sold in discrete units for postage meter use under a separate PCN for each particular rate table that may come into effect. Each such discrete PCN could be assigned a separate descending register or alternatively accounted for in a permanent postage FS database. Accordingly, when a user connects the postage meter 200 to the data center, a menu of postage refill options is available.

First, a traditional postage refill may be selected for a particular dollar value. Alternatively, permanent postage may be selected. In one embodiment, the permanent postage is available in penny increments, as is a traditional refill, but effective at the then current rate table forever. The mailing machine may ensure that it has a local copy of the then current rate table to be used before allowing the particular purchase. A separate PCN code may be assigned to the postage purchase for that effective rate table. In yet another alternative, discrete permanent postage "stamps" may be purchased, each under separate PCN as described above. When a new rate table is put into effect by the USPS, then the PCNs used are modified to reflect unique identification of the particular postage purchase options available.

Figure 7:
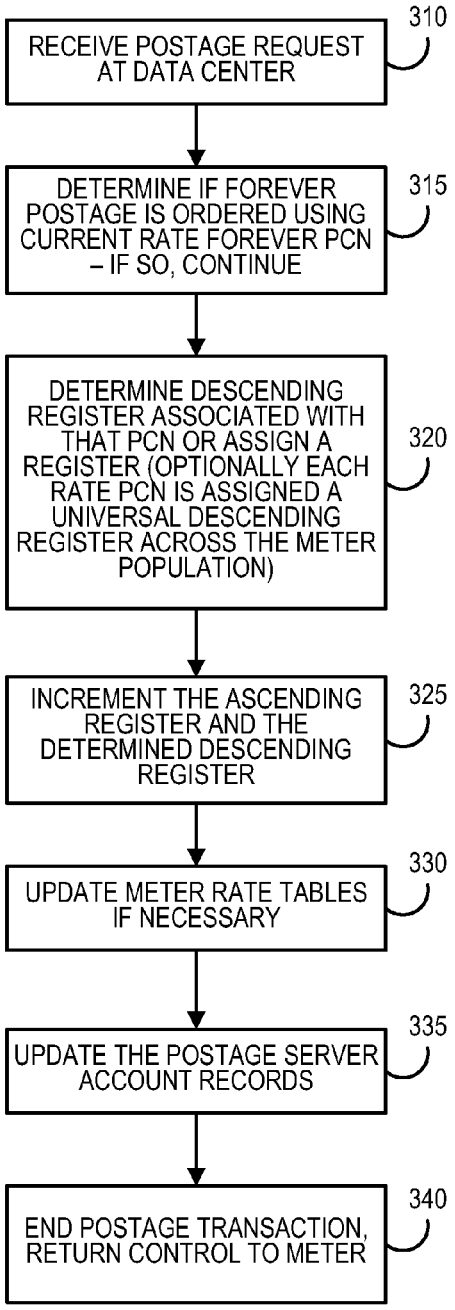
FIG. 7 is a flow chart describing an illustrative process for purchasing postage using a mailing machine according to an illustrative embodiment of the present application.

Referring to FIG. 7, a flow chart describing an illustrative process for purchasing postage using a mailing machine according to an illustrative embodiment of the present application is shown. In step 310, a remote data center receives a request from a mailing machine to process a postage meter refill operation. In step 315, the data center determines if permanent postage is selected. The postage meter may include menu options for permanent postage or the remote data center may make available certain compatible permanent postage PCNs for purchase. The remote data center may separately determine if the particular mailing machine supports permanent postage before offering it as an option.

In step 320, the data center determines the appropriate descending register associated with a selected permanent postage PCN. In one embodiment, the descending register assignments are consistent across the postage meter population. Alternatively, if no descending register is determined, a descending register may be assigned.

In step 325, the remote data center provides the required data to permit the PSD to increment the ascending register and the determined descending register. In optional step 330, the data center updates the mailing machine rate table if necessary. In step 335, the data center updates any required central postage data center account records. In step 340, the postage refill transaction ends normally and control is returned to the mailing machine user.

Figure 8:
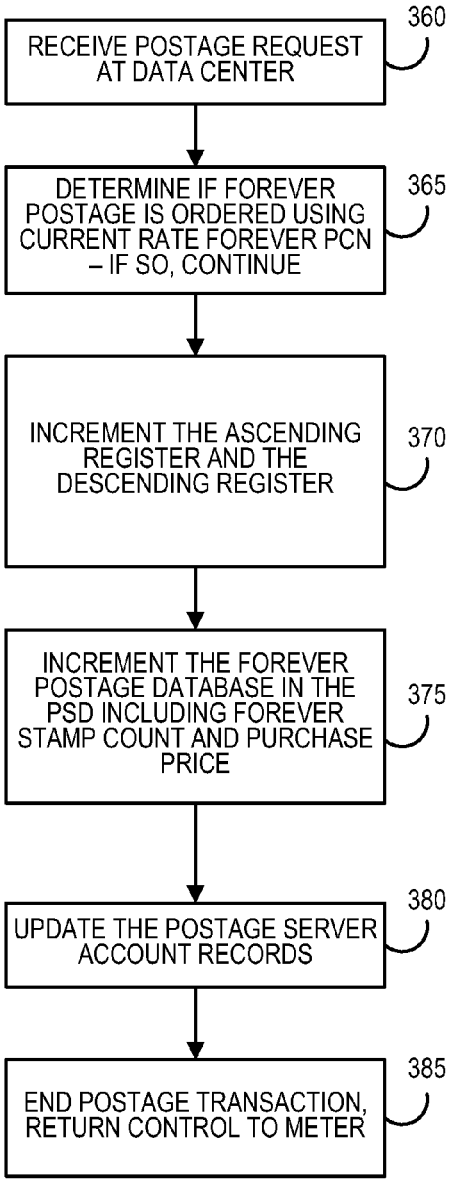
FIG. 8 is a flow chart describing an illustrative process for purchasing postage using a mailing machine according to another illustrative embodiment of the present application.

Referring to FIG. 8, a flow chart describing another illustrative process for purchasing postage using a mailing machine according to an illustrative embodiment of the present application is shown. In step 360, a remote data center receives a request from a mailing machine to process a postage meter refill operation. In step 365, the data center determines if permanent postage is selected. The postage meter may include menu options for permanent postage or the remote data center may make available certain compatible permanent postage PCNs for purchase. The remote data center may separately determine if the particular mailing machine supports permanent postage before offering it as an option.

In step 370, the remote data center provides the required data to permit the PSD to increment the ascending register and the descending register. Here, only one descending register is utilized, but a PSD permanent postage database is used to account for all permanent postage transactions. Accordingly, in step 375, the remote data center provides the required data to permit the PSD to update the permanent (Forever) postage database in the PSD such as by including a particular discrete Forever Stamp count and purchase price/rate information.

In step 380, the data center updates any required central postage data center account records. In step 390, the postage refill transaction ends normally and control is returned to the mailing machine user.

Figure 9:
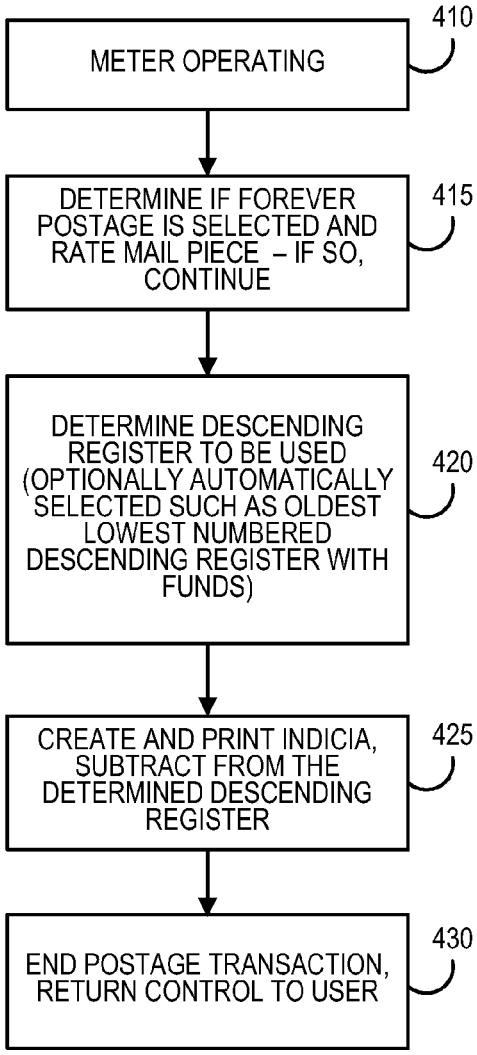
FIG. 9 is a flow chart describing an illustrative process for applying postage indicia using a mailing machine according to an illustrative embodiment of the present application.

Referring to FIG. 9, a flow chart describing an illustrative process for applying postage indicia using a mailing machine according to an illustrative embodiment of the present application is shown. In step 410, the meter is operating to allow a user to apply postage to a mail piece. In step 415, the mailing machine determines if the user has selected to use permanent postage. The mailing machine will provide rate selection information for setting the class of service and perhaps the rating/weight break or other postage break information. The mailing machine automatically selects from amongst the descending registers in order to select the appropriate permanent postage to be dispensed. Alternatively, if multiple registers are appropriate, the user may select from amongst the descending registers in order to select the permanent postage to be dispensed.

In step 420, if permanent postage is selected, the mailing machine determines the descending register to be used. Optionally, the mailing machine automatically selects the descending register such as by selecting the oldest descending register having sufficient funds. In step 425, the mailing machine creates and prints the permanent postage indicium such as by using one of the indicium formats described above with reference to FIGS. 2-4. The mailing machine also updates the appropriate descending register to account for the postage debit. In step 430, the mailing machine ends the postage transaction and returns control to the user.

Figure 10:
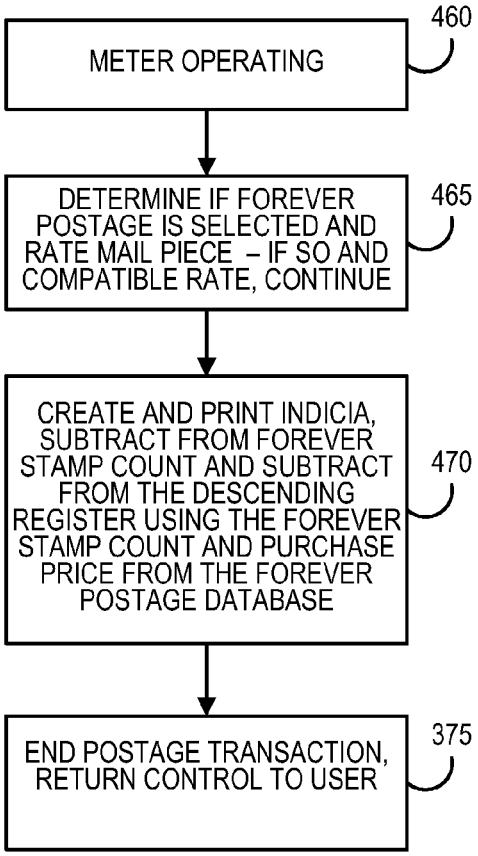
FIG. 10 is a flow chart describing an illustrative process for applying postage indicia using a mailing machine according to another illustrative embodiment of the present application.

Referring to FIG. 10, a flow chart describing another illustrative process for applying postage indicia using a mailing machine according to an illustrative embodiment of the present application is shown. In step 460, the meter is operating to allow a user to apply postage to a mail piece. In step 465, the mailing machine determines if the user has selected to use permanent postage. The mailing machine will provide rate selection information for setting the class of service and perhaps the weight break or other postage break information. The mailing machine automatically selects from amongst the descending registers in order to select the appropriate permanent postage to be dispensed. Alternatively, the user may select from amongst the descending registers in order to select the permanent postage to be dispensed. The mailing machine may also determine if a compatible permanent postage rate is selected.

In step 470, if permanent postage is selected, the mailing machine creates and prints the permanent postage indicium such as by using one of the indicium formats described above with reference to FIGS. 2-4. The mailing machine also updates the appropriate permanent postage database record in the PSD. In step 475, the mailing machine ends the postage transaction and returns control to the user.

While certain embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description.

What is claimed is:

1. A mailing machine comprising:

a printer for printing an indicium on a mail piece;

a controller coupled to the printer; and a first postal security device coupled to the controller, the first postal security device including:

a processor to generate at least one cryptographic portion of the indicium;

an ascending register operatively connected to the processor; and at least two concurrently available descending registers incorporated in the first postal security device that are each active for dispensing postage for use with a postal service and operatively connected to the processor, wherein the processor is configured after a first rate change date to dispense postage from one of the at least two concurrently available descending registers associated with an expired rate table until empty and to prevent further acceptance of new postage into the one of the at least two concurrently available descending registers associated with the expired rate table.

2. The mailing machine according to claim 1, wherein the at least two descending registers comprises at least three descending registers, wherein at least one of the at least three descending registers is associated with a specific rate table that is not associated with the remaining descending registers.

3. The mailing machine according to claim 1, further comprising:

at least two rate table records.

4. The mailing machine according to claim 3, wherein:

the at least two rate table records are operatively coupled to the controller.

5. The mailing machine according to claim 4, wherein:

the at least two rate table records respectively are associated with the at least two descending registers.

6. The mailing machine according to claim 1, wherein at least one of the descending registers is solely associated with a specific expired rate table and the indicium is generated including a reference to the specific expired rate table.

7. The mailing machine according to claim 1, wherein at least two of the descending registers is associated with a current rate table.

8. The mailing machine according to claim 1, wherein at least two of the descending registers are solely associated with respective expired rate tables and the indicium is generated including a reference to one of the expired rate tables.

9. The mailing machine according to claim 1, wherein one of the at least two concurrently available descending registers is selected to dispense postage based upon selecting a lowest numbered descending register holding sufficient postage.

10. A mailing machine comprising:

a printer for printing an indicium on a mail piece;

a controller coupled to the printer; and a postal security device coupled to the controller, the postal security device including:

a processor to generate at least one cryptographic portion of the indicium;

an ascending register operatively connected to the processor;

exactly one descending register operatively connected to the processor; and at least one permanent postage database operatively connected to the processor, wherein the processor is configured to store a first remaining balance associated with the descending register according to a first rate table active for dispensing postage and a second remaining balance associated with the descending register according to a second rate table active for dispensing postage in at least one permanent postage database.

11. The mailing machine according to claim 10, wherein a database record of the at least one permanent postage database associated with at least one of the first and second balance is not active for adding postage.

12. The mailing machine according to claim 10, further comprising:

at least two rate table records stored in the database, each only active for use in applying rates for adding postage until an associated rate table has expired.

13. The mailing machine according to claim 12, wherein:

the at least two rate table records are operatively coupled to the controller.

14. The mailing machine according to claim 13, wherein:

the at least one permanent postage database includes records holding at least two permanent postage count records respectively associated with two different rate tables; and the at least two rate table records respectively are associated with the at least two permanent postage count records.

15. The mailing machine according to claim 14, wherein at least one of the two permanent postage count records is associated with a specific expired rate table.

16. The mailing machine according to claim 14, wherein at least one of the two permanent postage count records is associated with a current rate table.

17. The mailing machine according to claim 14, wherein at least two of the two permanent postage count records are solely associated with respective expired rate tables.

18. A method of affixing a postal indicium comprising:

selecting a descending register from a set of at least two descending registers in a single postal security device having a processor that are simultaneously available for dispensing postage for use with a postal service;

generating, by the processor, at least one cryptographic portion of the indicium and the selected descending register; and printing the postal indicium on a mail piece using a printer, said postal indicium including an identifier associated with the selected descending register.

19. The method of claim 18, wherein:

selecting the descending register comprises selecting a lowest numbered descending register holding sufficient permanent postage.

20. The method of claim 18, wherein:

selecting the descending register comprises obtaining a descending record selection indication from a user.

* * * * *